US007856740B2

(12) United States Patent
De Bast et al.

(10) Patent No.: US 7,856,740 B2
(45) Date of Patent: Dec. 28, 2010

(54) SPORTS SHOE AND TIGHTENING STRAP FOR SUCH A SHOE

(75) Inventors: Jean-Francois De Bast, Monterrat (FR); Jean-Pierre Rigollet, Moulins (FR)

(73) Assignee: Time Sport International, Vaulx Milieu (FR)

( * ) Notice: Subject to any disclaimer, the term of this patent is extended or adjusted under 35 U.S.C. 154(b) by 750 days.

(21) Appl. No.: 11/780,592

(22) Filed: Jul. 20, 2007

(65) Prior Publication Data

US 2008/0016723 A1 Jan. 24, 2008

(51) Int. Cl.
*A43B 5/14* (2006.01)
*A43C 11/12* (2006.01)

(52) U.S. Cl. ..... 36/131; 36/50.1; 36/50.5; 24/68 SK; 24/DIG. 44; 24/593.11

(58) Field of Classification Search ..... 36/131, 36/50.1, 50.5; 24/68 SK, DIG. 44, 593.11, 24/70 SK, DIG. 43
See application file for complete search history.

(56) References Cited

U.S. PATENT DOCUMENTS 2,424,656 A * 7/1947 Goldblatt ..... 24/593.11
2,792,609 A * 5/1957 Pittman ..... 24/164
3,472,508 A * 10/1969 Baker et al. ..... 482/79
4,541,147 A * 9/1985 Olivieri ..... 24/68 SK
4,976,017 A * 12/1990 Frano ..... 24/578.1
7,533,478 B2 * 5/2009 Bird et al. ..... 36/50.1

FOREIGN PATENT DOCUMENTS

| | | |
|---|---|---|
| AT | 336 477 | 5/1977 |
| EP | 0 400 213 | 12/1990 |
| FR | 2 397 801 | 2/1979 |
| FR | 2 755 833 | 5/1998 |

* cited by examiner

*Primary Examiner*—Ted Kavanaugh
(74) *Attorney, Agent, or Firm*—Connolly Bove Lodge & Hutz LLP

(57) ABSTRACT

Sports shoe, in particular a cycling shoe, comprising at least one strap for securing the instep. The strap (B) comprises at least two parts, namely a first strap part (B1) provided, at one of its ends, with a first fastening means (A1), while its other end (2) is intended to be attached to the shoe, and a second strap part (B2) provided, at one of its end, with a second fastening means (A2) mating with the first, the other end (3) of this second strap part being intended to cooperate with a tensioning device, the cooperation between the fastening means allowing a preadjustment of the length of the strap (B) as a whole, while a locking means (V) is intended to occupy a first position in which the two fastening means (A1, A2) are maintained in a state of cooperation, and a second position in which the fastening means can be disengaged.

8 Claims, 2 Drawing Sheets

SPORTS SHOE AND TIGHTENING STRAP FOR SUCH A SHOE

This nonprovisional application claims priority under 35 U.S.C. §119(a) on Patent Application No(s). 06 06691 filed in France on Jun. 21, 2006, the entire contents of which are hereby incorporated by reference.

The invention relates to a sports shoe comprising at least one strap for securing the instep, one end of which strap is attached to one side of the shoe and the other end of which strap is designed to cooperate with a tensioning device provided on the other side of the shoe for exerting the tightening action.

The invention relates more specifically to a cycling shoe.

Owing to the different shapes of users' feet, the ability to be able to secure a narrow instep and a wider instep equally well requires the tightening strap to have a useful length which is at least sufficient for securing the widest instep imaginable. The result of this is that when a much narrower instep has to be secured, the length of the strap is considerably greater than is necessary, and part of the strap extends unnecessarily beyond the tensioning device. Moreover, this end of the strap protruding from the tensioning device is a nuisance.

Furthermore, the strap is generally equipped with a pad or cushion to spread the tightening action over the instep. It is desirable for the positioning of this cushion on the instep to remain centred in spite of the variations in the dimensions of the instep from one person to another.

The aim of the invention especially is to provide a sports shoe, in particular a cycling shoe, of the above-defined type which makes it possible in a simple and economic manner to limit the protrusion of the strap with respect to the tensioning device, in spite of the possible variations of the user's instep.

According to the invention, a sports shoe, in particular a cycling shoe, of the above-defined type is characterized in that the strap comprises at least two parts, namely a first strap part provided, at one of its ends, with a first fastening means, while its other end is attached to the shoe, and a second strap part provided, at one of its end, with a second fastening means mating with the first, the other end of this second strap part being intended to cooperate with the tensioning device, the cooperation between the fastening means allowing a preadjustment of the length of the strap as a whole, while a locking means is intended to occupy a first position in which the two fastening means are maintained in a state of cooperation, and a second position in which the fastening means can be disengaged.

According to the invention, the preadjustment of the strap provides an adaptation to the instep, the tensioning device then allowing the tightening action.

Advantageously, the locking means comprises a tunnel cap in which the parts of the strap can be engaged, this tunnel cap being designed to slide along at least one of the strap parts when it is desired to adjust the length of the strap, the tunnel cap being sufficiently clamped or immobilized when it covers the fastening means of the two parts so as to maintain them in a state of cooperation.

The tunnel cap may comprise a relatively rigid upper part in which the tunnel is provided, and a cushion-forming flexible lower part, so that it can be pressed correctly against the shoe upper and not create a hard point. The tunnel cap may have dimensions sufficient to fully cover the mutual fastening means, irrespective of the adjustment position chosen for the length of the strap.

Preferably, the fastening means comprise a male part with laterally projecting lugs and a female part with fastening seats in the form of slots for receiving the lugs.

The lugs and slots may have one of the following shapes: dovetail, rectangular crenellation, rounded.

Advantageously, laterally projecting lugs are provided on each of the longitudinal sides of the male part, while the female part comprises two branches designed to flank the male part, each branch comprising, on its inner edge, slots forming seats for the lugs of the male part.

The two branches of the female part may be connected, at their free end, by a cross-piece situated beneath the thickness of the branches of the female part such that the male part can be inscribed within a window limited by the branches of the female part by passing over the cross-piece.

The fastening means are advantageously intended to allow three relative positions to be adopted between the strap parts, to which positions there corresponds three different lengths, namely a short length, a medium length and a long length.

The invention also relates to a strap for a sports shoe, in particular a cycling shoe, as defined above, this strap being characterized in that it comprises at least two parts, namely a first strap part provided, at one of its ends, with a first fastening means, while its other end is intended to be attached to the shoe, and a second strap part provided, at one of its ends, with a second fastening means mating with the first, the other end of this second strap part being intended to cooperate with a tensioning device, the cooperation between the fastening means allowing a preadjustment of the length of the strap as a whole, while a locking means is intended to occupy a first position in which the two fastening means are maintained in a state of cooperation, and a second position in which the fastening means can be disengaged.

Preferably, the locking means comprises a tunnel cap in which the parts of the strap can be engaged, this tunnel cap being intended to slide along at least one of the strap parts when it is desired to adjust the length of the strap, the tunnel cap being sufficiently clamped or immobilized when it covers the fastening means of the two parts so as to maintain them in a state of cooperation.

Apart from the arrangements set out above, the invention consists of a certain number of other arrangements which will be discussed in more detail below by way of exemplary embodiments described with reference to the appended drawings, but which are in no way limiting. In these drawings.

Figure 1:
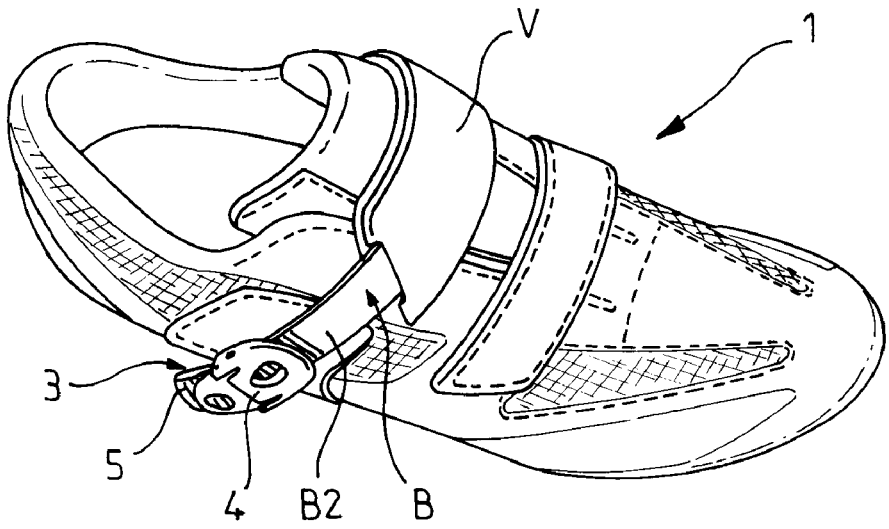
FIG. 1 is a perspective view of the outer side of a right cycling shoe according to the invention.
Figure 2:
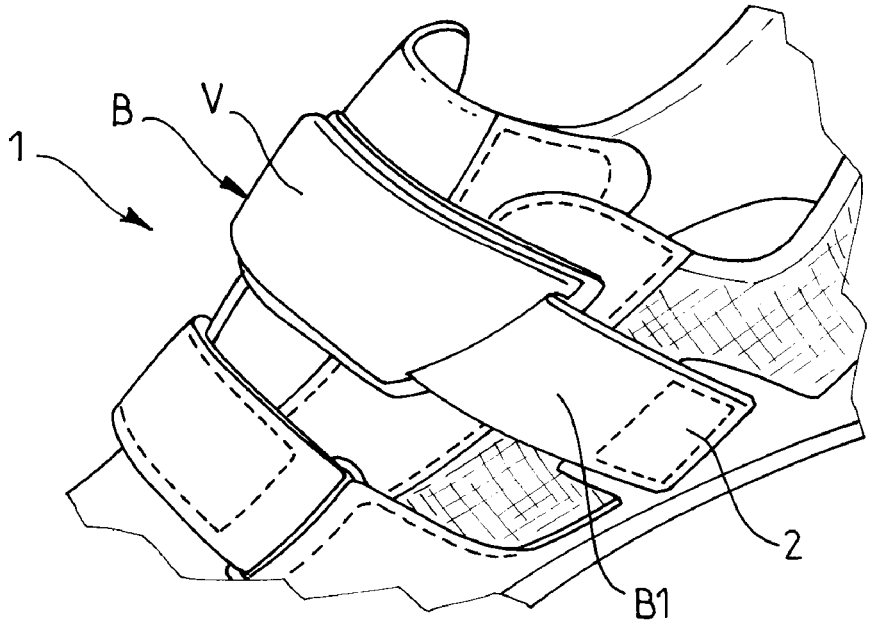
FIG. 2 is a perspective view of the inner side of part of the cycling shoe shown on a larger scale than in FIG. 1.

With reference to the drawings, particularly to FIGS. 1 and 2, a cycling shoe 1 can be seen which comprises at least one strap B for securing the instep. According to the exemplary embodiment, another strap is provided at a lower level than the strap B.

One end 2 of the strap B is attached, on one side of the shoe, generally on the inner side, by any suitable means, in particular by stitching or by riveting. The other end 3 of the strap is designed to cooperate with a tensioning device 4, generally consisting of a ratchet buckle device which cooperates with notches 5 provided at the end 3. The ratchet buckle makes it possible to exert a tightening action on the strap B, notch by notch, by way of an actuating lever.

As can be seen in FIG. 3 to FIG. 6, the strap B according to the invention comprises at least two parts B1, B2. A first strap part B1 is provided at one of its ends with a first fastening means A1, while its other end 2 is intended to be attached to the shoe. A second strap part B2 is provided at one of its ends with a second fastening means A2 mating with the first A1. The other end 3 of this second part B2 is intended to cooperate with the tensioning device 4.

The cooperation between the fastening means A1, A2 allows a preadjustment of the useful length of the two strap parts as a whole. A locking means V is intended to occupy a first position, illustrated in solid line in FIGS. 3 to 6, in which the two fastening means A1, A2 are maintained in a state of cooperation, and a second position, represented in dot-dashed line in FIGS. 3 and 5, in which the fastening means A1, A2 are released.

The locking means V advantageously consists of a tunnel cap 6 in which the parts of the strap are engaged, this tunnel cap 6 being intended to slide along the strap parts when it is desired to adjust the system, and to disengage the mating attachment means A1, A2. After adjustment, the cap V covers the attachment means A1, A2, mainly in their regions of cooperation, and is sufficiently clamped or immobilized to retain its position. The cap 6, in plan view, has a substantially rectangular shape with a curved upper large side which is concave towards the top so as to follow the shape of the instep; the lower large side is represented convex towards the bottom in FIGS. 3 and 5, but can be contemplated to have any other curvature depending on the desired appearance.

The tunnel cap 6 is preferably composed of a relatively rigid upper part 6*a*, for example made in a semi-rigid plastic to ensure that the latching holds firm, and of a flexible lower part 6*b* pressed against the shoe upper. The upper part of the cap comprises the tunnel 7 which can slide along the strap while being sufficiently clamped or immobilized, for example by means of micronotches, under normal circumstances. The height of the tunnel 7 in the rigid part 6*a* of the cap is substantially equal to the thickness e of a strap part B2 or B1, the two parts preferably having the same thickness. The lower part 6*b* is made of a flexible plastic, for example flexible TPU (thermoplastic polyurethane) foam. This lower part 6*b*, situated on the shoe upper side, constitutes a flexible cushion suitable for pressing against the upper without creating a hard point for the foot.

The fastening means preferably comprise a male fastening means A1 and a female fastening means A2.

Figure 3:
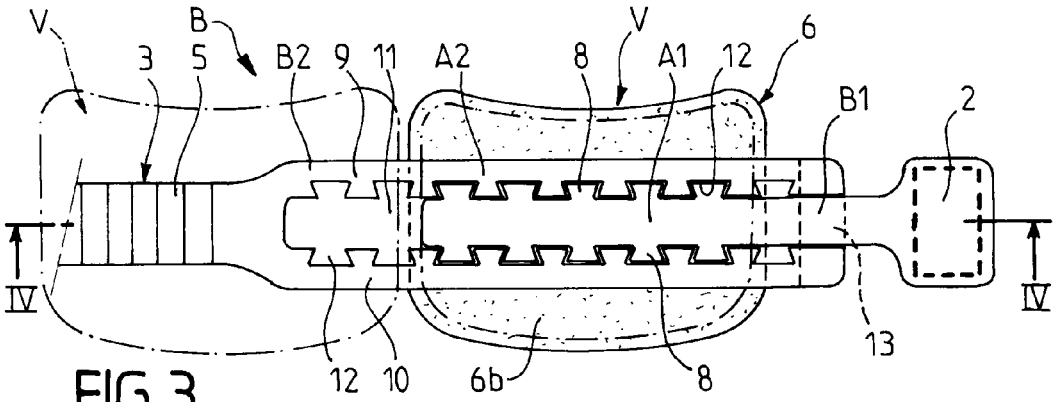
FIG. 3 is a plan view on an enlarged scale, with part cut away, of a strap according to the invention.
Figure 4:
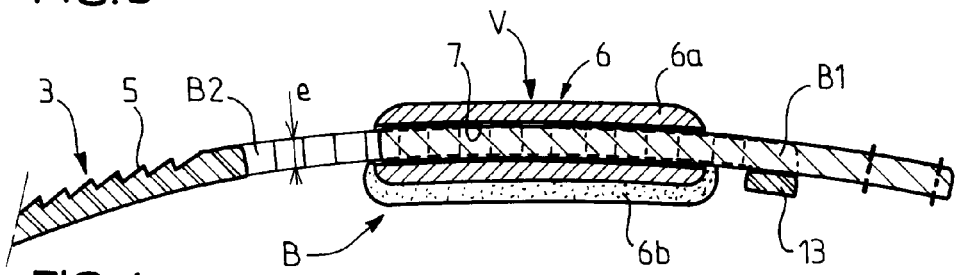
FIG. 4 is a section taken on line IV-IV of FIG. 3.

According to the exemplary embodiment shown in FIGS. 3 and 4, the male fastening means A1 comprises laterally projecting lugs 8 in the form of dovetails, on each longitudinal side of the strap part B1.

The female part B2 comprises two branches 9, 10 flanking a longitudinal window 11 in which the strap part B1 can be placed. The inner longitudinal edges of the branches 9 and 10 are provided with seats 12 consisting of slots in the form of dovetails which mate with the dovetails 8.

The lugs 8 and the slots 12 constitute regions of fastening between the two strap parts B1 and B2. A preadjustment of the useful length of the strap as a whole can be made by engaging the lugs 8 in a given group of slots 12.

The number of lugs 8 is chosen to ensure sufficient tensile mechanical strength. The number of slots 12 is at least equal to the number of lugs 8 increased by the number N−1, where N equals the number of preadjustments desired using the strap parts B1 and B2.

According to the example of FIG. 3, five lugs 8 are provided on each side of the male part A1, while eight slots 12 are provided in the female part, allowing four preadjustment lengths for the strap B.

Advantageously, the number of fastening lugs 8 will be reduced to a minimum value in order to limit the overall size. Two or more preadjustment positions are provided. An advantageous embodiment is obtained with three preadjustment positions, corresponding to a short useful length, a medium useful length and a long useful length for the two straps B1, B2 as a whole.

Preferably, the tunnel cap 6 has dimensions which are sufficient to fully cover the mutual fastening regions, irrespective of the chosen adjustment position. This arrangement corresponds to FIGS. 5 and 6, but does not correspond to the representation shown in FIGS. 3 and 4 in which slots 12 are visible on either side of the cap 6 when it covers the region of cooperation between the slots 12 and the lugs 8.

Owing to the reduced height of the tunnel 7, this tunnel can slide to cover the strap parts only when the lugs 8 are engaged in slots 12 so that the thickness of the region where the fastening means cooperate remains equal to e, which would not be the case if the strap parts B1, B2 were superposed.

Those ends of the branches 9, 10 of the female part B2 remote from the region provided with the notches 5 are preferably joined together by a cross-piece 13 connecting the lower faces of the branches 9, 10 so as to leave the passage free above this cross-piece 13 for the strap B1.

Figure 5:
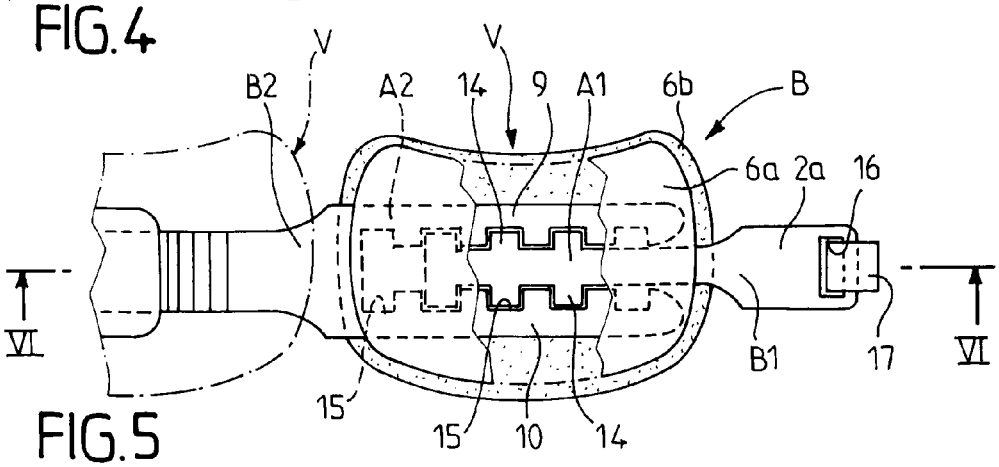
FIG. 5 is a plan view with part cut away, of a variant embodiment of the strap, and finally

FIG. 5 shows a variant embodiment in which the laterally projecting lugs, on the longitudinal edges of the male part B1 are formed by rectangular crenellations 14, while the slots 15 of the female part have a complementary rectangular shape.

Figure 6:
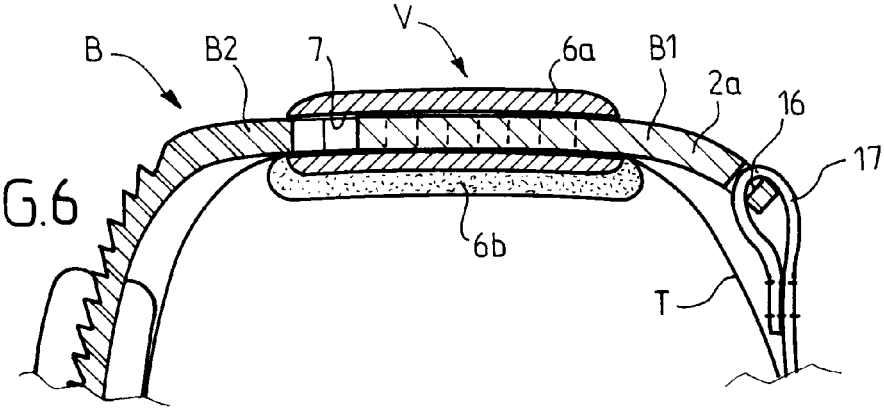
FIG. 6 is a section taken on line VI-VI of FIG. 5 of the strap in place on a schematically represented shoe.

The end 2*a* of the male strap B1, according to FIGS. 5 and 6, comprises a window 16 through which a band 17 is passed in order to form a closed loop. The band 17 is fixed to the shoe upper T (FIG. 6), in particular by stitching (not shown).

According to the exemplary embodiment shown in FIGS. 5 and 6, the male strap B1 comprises three lugs 14 on each side, while the branches of the female strap comprise five slots 15 on their longitudinal internal edges, thereby making possible three adjustments of the useful length of the strap parts B1 and B2 as a whole.

The way in which the strap B according to the invention is used is as follows:

With the end 3 of the strap released from the ratchet buckle 4, the user slips his foot into the shoe so that he can proceed to preadjust the strap length.

The user slides the tunnel cap 6 towards the left according to the presentation shown in FIGS. 3 to 6 to disengage the fastening means and to withdraw the lugs 8, or 14, from the slots 12, or 15.

Depending on the shape of his foot, the user moves the strap parts B1, B2 towards or away from one another in order to engage the lugs in the slots in a suitable position for obtaining the appropriate length.

Following this operation, the user slides the tunnel cap 6 to cover the engaged lugs and slots, and lock the assembly. The tunnel 7 itself exerts a clamping action on the strap parts B1, B2, maintaining them in position.

If the strap end 3 has been withdrawn from the ratchet buckle 4, the user engages this end in the ratchet buckle, after which he performs the actual tightening operation by acting on this ratchet buckle. On account of the preadjustment of the strap parts B1, B2 as a whole, tightening is achieved by advancing the end 3 by a limited number of notches 5 into the ratchet buckle. The tunnel cap 6 remains in a centred position on the instep.

Thus, the invention makes it possible to adjust the useful length of the strap B of a cycling shoe to suit the instep of the individual. This avoids having to provide standard single-piece straps, which would be too long for cyclists having a narrow foot.

Although the exemplary embodiments described concern cycling shoes, the invention can be applied to other types of sports shoes or boots, for example cross-country ski boots.

The invention claimed is:

1. Sports shoe, in particular a cycling shoe, comprising at least one strap for securing the instep, one end of which strap is attached to one side of the shoe and the other end of which strap is designed to cooperate with a tensioning device provided on the other side of the shoe, wherein:

the strap (B) comprises at least two parts, namely a first strap part (B1) provided, at one of its ends, with a first fastening means (A1), while its other end (2, 2*a*) is attached to the shoe, and a second strap part (B2) provided, at one of its end, with a second fastening means (A2) mating with the first, the other end (3) of this second strap part being intended to cooperate with the tensioning device (4), the cooperation between the fastening means allowing a preadjustment of the length of the strap (B) as a whole, while a locking means (V) is intended to occupy a first position in which the two fastening means (A1, A2) are maintained in a state of cooperation, and a second position in which the fastening means can be disengaged, and the locking means (V) comprises a tunnel cap (6) in which the parts of the strap (B1, B2) can be engaged, this tunnel cap being designed to slide along at least one of the strap parts when it is desired to adjust the length of the strap, the tunnel cap being sufficiently clamped or immobilized when it covers the fastening means of the two parts so as to maintain them in a state of cooperation.

2. Shoe according to claim 1, wherein the tunnel cap (6) comprises a relatively rigid upper part (6A) in which the tunnel (7) is provided, and a cushion-forming flexible lower part (6B), so that it can be pressed correctly against the shoe upper and not create a hard point.

3. Shoe according to claim 1, wherein the tunnel cap (6) has dimensions sufficient to fully cover the mutual fastening means (A1, A2), irrespective of the adjustment position chosen for the length of the strap (B).

4. Shoe according to claim 1, wherein the fastening means (A1, A2) comprise a male part (A1) with laterally projecting lugs (8, 14) and a female part (A2) with fastening seats in the form of slots (12, 15) for receiving the lugs.

5. Shoe according to claim 4, wherein the lugs (8, 14) and slots (12, 15) have one of the following shapes: dovetail, rectangular crenellation, rounded.

6. Shoe according to claim 4, wherein laterally projecting lugs (8, 14) are provided on each of the longitudinal sides of the male part (A1), while the female part (A2) comprises two branches (9, 10) designed to flank the male part, each branch comprising, on its inner edge, slots (12, 15) forming seats for the lugs of the male part.

7. Shoe according to claim 6, wherein the two branches (9, 10) of the female part (A2) are connected, at their free end, by a cross-piece (13) situated beneath the thickness of the branches of the female part such that the male part (A1) can be inscribed within a window (11) limited by the branches (9, 10) of the female part by passing over the cross-piece (13).

8. Shoe according to claim 4, wherein the fastening means (A1, A2) are intended to allow three relative positions to be adopted between the strap parts, to which positions there corresponds three different lengths, namely a short length, medium length and long length.

* * * * *